US006640967B2

(12) United States Patent
Mathias et al.

(10) Patent No.: US 6,640,967 B2
(45) Date of Patent: Nov. 4, 2003

(54) FOLDABLE LENS BOX BLANK AND OPHTHALMIC LENS BOX FORMED THEREFROM

(75) Inventors: Gregory T. Mathias, Oakdale, MN (US); Mehmed Temim, Little Canada, MN (US)

(73) Assignee: Vision-Ease Lens, Inc., Ramsey, MN (US)

( * ) Notice: Subject to any disclaimer, the term of this patent is extended or adjusted under 35 U.S.C. 154(b) by 0 days.

(21) Appl. No.: 10/012,449

(22) Filed: Oct. 19, 2001

(65) Prior Publication Data

US 2003/0075465 A1 Apr. 24, 2003

(51) Int. Cl.[7] ..... B65D 85/38; B65D 85/48

(52) U.S. Cl. ..... 206/5; 206/316.1; 206/454; 206/485

(58) Field of Search ..... 206/303, 316.1, 206/5, 445, 449, 454, 485; 229/183

(56) References Cited

U.S. PATENT DOCUMENTS

| | | | | |
|---|---|---|---|---|
| 1,968,660 A | | 7/1934 | Towell | 229/41 |
| 1,968,661 A | | 7/1934 | Towell | 229/41 |
| 2,372,312 A | | 3/1945 | Buttery | 229/16 |
| 2,939,622 A | * | 6/1960 | D'Ippolito | 206/485 |
| 3,122,298 A | | 2/1964 | Seger, Jr. | 229/16 |
| 5,121,838 A | * | 6/1992 | Dickie | 206/454 |
| 5,333,732 A | * | 8/1994 | Budny et al. | 206/316.1 |
| 5,454,469 A | | 10/1995 | Budny et al. | 206/316.1 |

* cited by examiner

*Primary Examiner*—Jacob K. Ackun
(74) *Attorney, Agent, or Firm*—Mark A. Litman & Assoc. P.A.

(57) ABSTRACT

The invention includes both a lens box blank and a lens box. The lens box blank that is folded into a lens box may, for example, comprise: a cross-bar alignment of box segments and a vertical stem alignment of box segments; the vertical stem alignment of segments including at least a front flap, a top flap, a bottom flap, and a rear flap separated by folding lines between flaps; the cross-bar alignment of box elements comprising in symmetry about the bottom flap at least two side flaps, at least two support frame top flaps, at least two lens support frame flaps with an opening in each lens support frame flap to nestle a lens, and at least two lens support frame securing flaps. The lens box blank may have at least one of the rear flap segment and the bottom flap has a flap extension thereon. The lens box blank may also have the lens box support frame flap openings as at least partially arcuate. Also, the top flap and at least one support frame top flap may have a tab engaging system to connect the top flap and the support frame top flap. A winged T-square lens box frame includes additional locking elements for securing the lens box into a closed position with a lens therein.

12 Claims, 4 Drawing Sheets

FOLDABLE LENS BOX BLANK AND OPHTHALMIC LENS BOX FORMED THEREFROM

BACKGROUND OF THE INVENTION

1. Field of the Invention

The present invention relates generally to enclosing generally disc-shaped objects in a box for safe storage. More specifically, the invention relates to both a lens box blank and a lens box erected from the lens box blank, the lens box being suitable for enclosing an optical lens blank, particularly an ophthalmic lens blank, with the lens blank being secured by the box structure to prevent both horizontal and vertical movement of the lens blank in the box during transportation, and to prevent trauma to the lens blank during light impact.

2. Background of the Art

Lens blanks are used as the starting material for corrective lenses in eyeglasses. These "generic" lens blanks are manufactured in bulk quantity by lens manufacturers with or without any particular refractive correction. The lenses basically have a convex top, concave bottom and cylindrical side wall. The side wall is eventually cut or ground to the proper fit within an ophthalmic lens frame. The correction is prepared by molding into the lens blank or by a combination of lens elements to form the appropriate prescription from a prescribing optician. Thus, the lens manufacturer is able to form or manufacture generic lens blanks in large production quantities. When a patient is treated, and corrective lenses are prescribed by an optometrist or other professional, an optician may be employed to select the proper lens or combine the proper lens blanks. To prevent an optician from having to maintain a very large supply of lenses all tailored to different prescriptions, lens blanks may be utilized. In that case, an optician would then select a generic lens blank and grind it to the required correction or frame fit. With the large number of lenses being prescribed, there is a large number of lens blanks being shipped from the manufactures to optical shops across the country.

The "generic" lens blanks have a convex top surface, a concave bottom and a generally cylindrical side wall. The lens blanks are usually designed and manufactured so that the convex top may remain in tact, the grinding occurring only on the bottom surface (and sides for frame fit). Thus it is important that the convex top surface remain free of any scratches or other imperfections as it will not be subsequently abraded or smoothed. Therefore, an important consideration in designing an enclosure box for transportation of such lens blanks is that contact between the convex top surface of the lens blank and the shipping container must be minimized during shipment. The shipping container should also be sufficiently sturdy that if accidental impact occurs during transportation, the box will absorb the impact without exposing the ophthalmic lens blank to contact with an abrading surface. The lens blank must be retained within the shipping enclosure such that vertical movement of the lens blank within the enclosure is minimized. One additional benefit of restricting movement on the lens blank is elimination of the annoying "rattling" that accompanies random movement of an unsecured object within a box.

Numerous examples exist of containers adapted to transport lenses and the like. One example of such prior art is Seger, U.S. Pat. No. 3,122,298, which discloses a container having slightly inclined sidewalls, handles, and a removable top. In the Seger enclosure, the inclination of the side walls is outwardly from the base upward. Thus, the Seger enclosure would not be operative to prevent vertical movement of the lens blank.

Another prior art example of a container is Buttery, U.S. Pat. No. 2,372,312, which discloses a folding octagon paper box having a general folding pattern and configuration for assembly of an octagonal container. Buttery does not have inclined sidewalls and thus would not be adapted to restrict vertical movement of the lens blank.

Towell, U.S. Pat. Nos. 1,968,660 and 1,968,661, show open topped display containers for candy and other confectionery having outwardly inclined side walls and no top to enclose the container.

Yet other prior art includes the use of styrofoam half sections to enclose lens blanks which are then manually inserted into a box enclosure for shipment.

U.S. Pat. No. 5,454,469 describes a lens box for safe storage and transportation of an optical lens blank having convex top and concave bottom surfaces and a cylindrical side wall, the junction of said top and bottom surfaces with said side wall defining a top ridge and a bottom ridge, comprising:

vertically spaced apart, substantially parallel top panel and bottom panel;

horizontally spaced apart, substantially parallel first and second side walls, said side walls being generally perpendicularly connected to said top and bottom panels;

a plurality of gussets, each of said gussets being connected to said top and bottom panels thereby defining an interior generally enclosed space between said top and bottom panels, said side walls and said gussets, each gusset and said top panel further defining an interior angle and an exterior angle, and each gusset and said bottom panel further defining an interior angle and an exterior angle and wherein said interior angle between each gusset and said top panel is greater than said interior angle between that same gusset and said bottom panel such that said gussets are inclined upwardly and inwardly from said bottom panel such that upon insertion of a said lens blank into said lens box, said gussets tangentially contact said lens blank top ridge at a point corresponding to the intersection of said lens blank side wall and said gussets thereby securing said lens blank against any substantial horizontal and vertical movement in said box.

SUMMARY OF THE INVENTION

The invention encompasses both a T-square lens box blank that can be folded and secured to form a lens box and the lens box formed from the lens box blank. The cross-bar of the T-square lens box blank has slidable/adjustable lens supporting frames on both sides of the cross-bar. The rear stem of the T-square lens box blank provides the top of the lens box structure and both the front and rear of the lens box. The resultant lens box places little contact surface area of the internal box support against the front lens surface, with the majority of the lens support being provided by contact of the lens box with the edges of the lens, not the viewing surface of the lens.

DETAILED DESCRIPTION OF THE INVENTION

Figure 1:
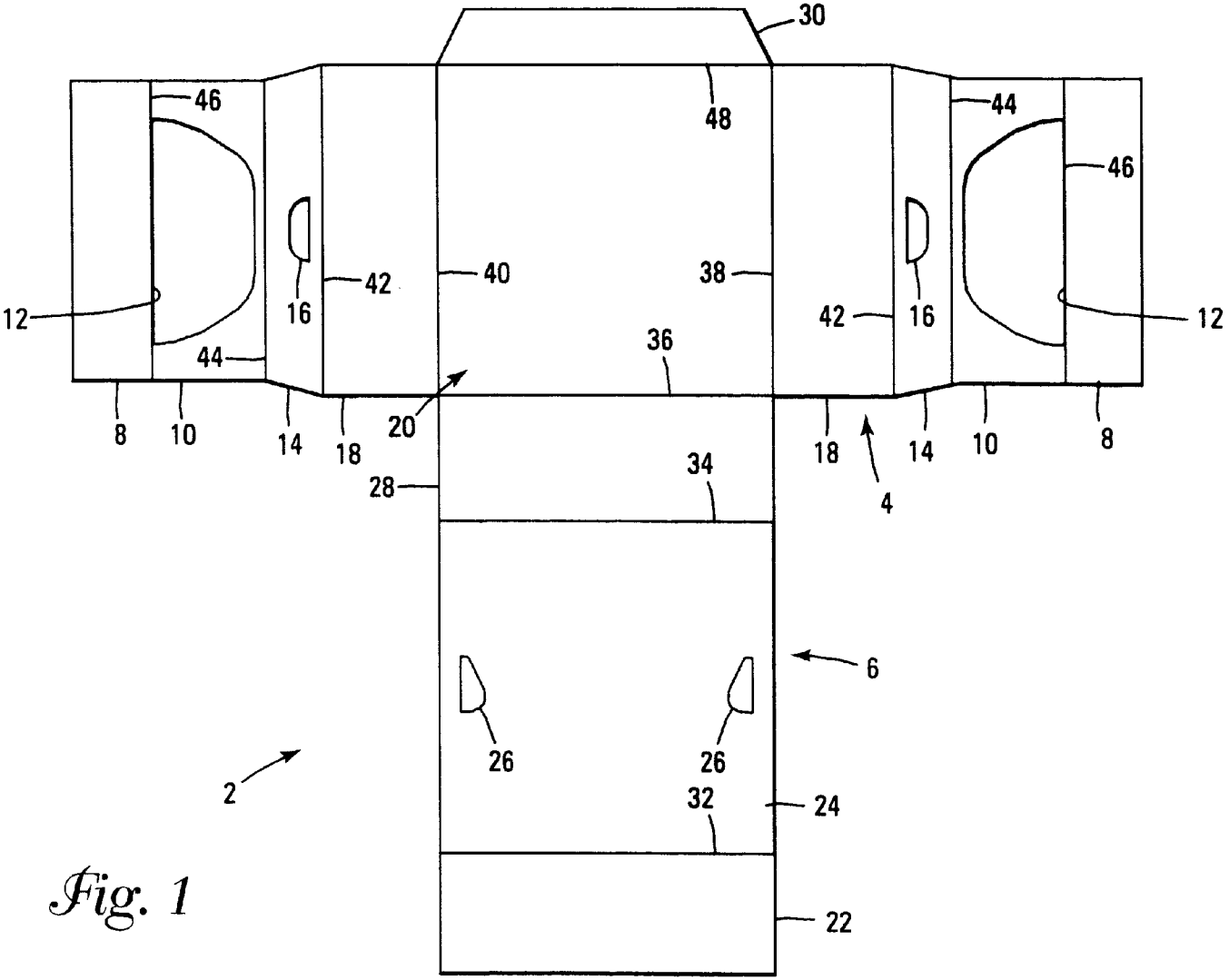
FIG. 1 shows a completely opened T-square lens box blank that can be folded and secured into a lens box.

A lens box according to the present invention has many advantages over other available lens boxes. The lens box of the invention can, for example:

a) provide a lens box blank that can be easily cut or converted to fit different size lenses, without having to alter the overall size of the lens box frame b) can be used on a wide variety of semi-finished lenses with different surface treatments, without modification of the box structure;

c) the box structure will minimize the potential for scratching within the box, both during transportation and insertion of the lens into the box;

d) the box is capable of firmly supporting lenses within the box with minimum potential for contact between the front of the lens and surfaces of the box;

e) the box structure eliminates the use of supplemental lens supports within the box, such as plastic cups, foam sheets, or packing material, and eases recycling problems or environmental issues since a paper-based composition for the box allows for a single composition recycling requirement, and paper is the most easily recycled material;

f) is very inexpensive as compared to existing commercially viable lens box systems;

g) lends itself to automated packaging techniques because of the simple folding and securing steps that are used in construction from the T-square;

h) lends itself to direct recycling/reuse, rather than merely recycling;

i) is readily openable and closable without destruction or diminution of the box integrity or appearance; and j) provides a very secure reduced dust environment, both because of its relatively tight closure and complete surrounding of the lens, and because of plastic enclosure elements that can generate triboelectric charges.

The invention includes both a lens box blank and a lens box. The lens box blank for folding into a lens box may, for example, comprise:

a cross-bar comprising aligned box segments and a stem comprising aligned box segments;

the stem box segments including at least a front panel, a top panel, a bottom panel, and a rear panel separated by folding lines between panels;

the cross-bar box segments comprising in symmetry about the bottom panel at least two side panels, at least two lens support frame top panels, at least two lens support frame side panels, each lens support side panel with an opening to nestle a lens, and at least two lens support frame securing flaps. The lens box blank may have at least one of the rear panel and the bottom panel provided with a securing flap thereon. The lens box blank may also have the lens support frame side panel openings as at least partially arcuate. Also, the top panel and the at least one lens support frame top panel may have a tab engaging system to connect the top panel and the at least one lens support frame top panel.

The lens box for holding an ophthalmic lens may comprise:

a cross-bar comprising aligned box segments and a stem comprising aligned box segments;

the stem box segments including at least a front panel, a top panel, a bottom panel, and a rear panel separated by folding lines between panels;

the cross-bar alignment of box elements comprising, in symmetry about the bottom panel, at least two side panels, at least two lens support frame top panels, at least two lens support frame panels with an opening in each lens support frame panel to nestle a lens, and at least two lens support frame securing flaps, the lens support frame securing flaps being secured to the bottom panel to allow three sides of a quadrilateral frame formed by the bottom panel, a side panel, a support frame top panel and a lens support frame panel to be able to shift parallel to the support frame top panel.

The box of the invention can be manufactured from traditional paper product sheeting, usually high quality paper products, light cardboard products, glossy (high quality surface coated) paper products, paper board products, clay coated paper board products, and the like. The coating weight may be selected as desired, as between 0.05 to 5 $kg/m^2$ or 0.1 and 3 $kg/m^2$ sheet. A better understanding of the blank and the box can be appreciated by consideration of the figures.

FIG. 1 shows a T-square lens box blank 2 that consists of a cross-bar segment 4 and a vertical stem section 6. The cross-bar segment 4 tends to be approximately symmetrical with two lens support frame securing panels 8, two lens support frame flaps 10 (with lens support holes 12 therein), two lens support frame top elements 14 (with optionally preferred closure or locking element 16), and lens box side 18. The intersection of the cross-bar 4 and the vertical stem segment 6 includes the bottom of the box segment 20. The vertical stem segment 6 comprises a top of the box securing flap 22, the top of the box segment 24 (with two optionally preferred closure engagement elements 26), front of the box segment 28, the bottom of the box segment 20, and preferably a securing flap 30. All straight, solid lines (e.g., 32, 34, 36, 38, 40, 42, 44, 46, and 48) are foldable lines, serrations, embossments or the like.

Figure 2A:
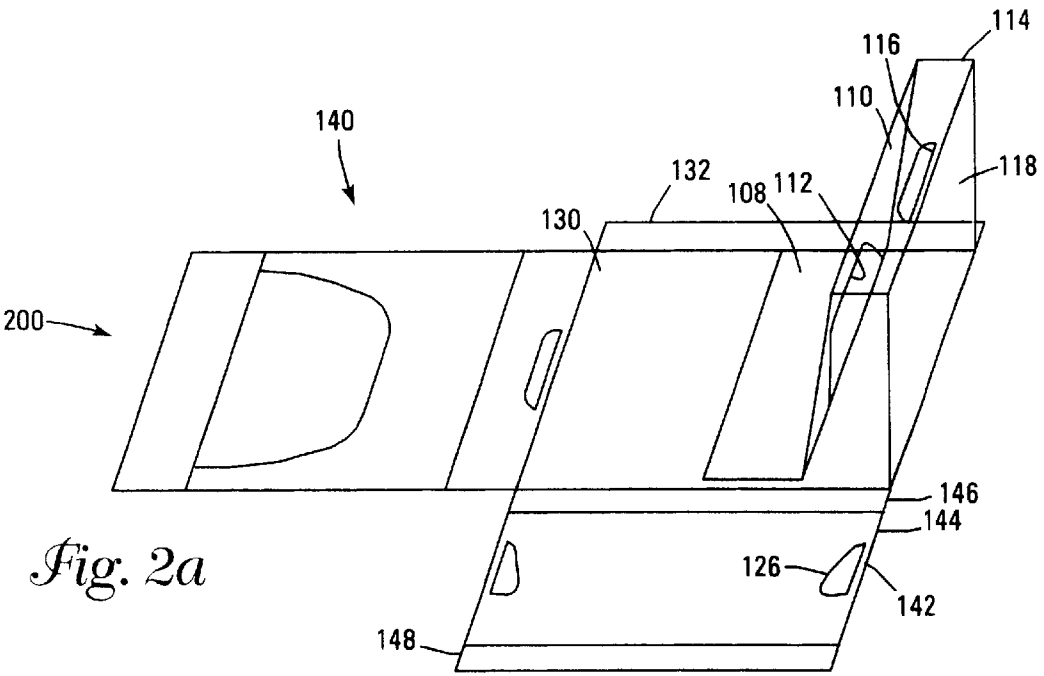
FIGS. 2*a*) and 2*b*) show perspective views of partially folded T-square lens box blanks that are in a process of being folded into a lens box.

FIG. 2A) shows a partially folded T-square lens box frame 100, with one symmetrical side of the cross-bar segment 102 being folded into a lens box shape. A side segment 118 has been partially elevated, also raising a support frame top element 114, a lens support frame panel 110 (with lens securing opening 112 therein) and a lens support frame-securing flap 108. The folding and securing of the T-square lens box blank 100 continues by lowering the lens support frame securing flap 108 into contact with a surface 130 of the lens box bottom panel 130 (20 in FIG. 1) and then securing (adhering, fusing, bonding, stapling, or otherwise associating) the lens support frame securing flap 108 to a surface of the lens box bottom segment 130.

Figure 2B:
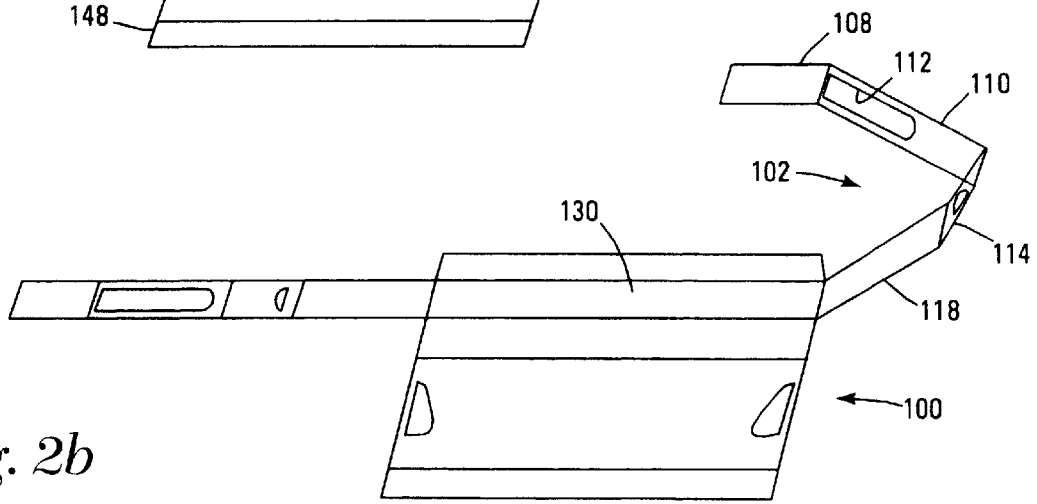

FIG. 2B) shows a perspective view of T-square lens block box 2 more completely folded, yet still incompletely folded. The panel 118 is shown in a relatively vertical position with regard to the lens box bottom segment 130, although, as explained in greater detail later, the lens box side segment 118, the support frame top element 114, and the lens support frame panel 110 (with lens securing opening 112 therein) shift or float or rotate to enable positioning of the lens securing opening 112 over a lens (not shown) placed within the box (not shown completed). The lens support frame-securing panel 108 is secured to the lens box bottom 130 to stabilize the movement of the lens box side 118. All three segments, the lens box side segment 118, the support frame top panel 114, and the lens support frame side panel 110 (with lens securing opening 112 therein) shift to enable the lens support frame side panel 110 to engage a lens with the lens securing opening 112. The other side 104 of the cross-bar 4 folded in a similar manner. The remainder of the unfolded stem segment 142 would also be folded in a logical sequence to complete the lens box (not shown). The lens box front 146 is folded upward (the size is relatively skewed because of the perspective), the lens box top panel 144 is folded over the top of the lens support frame top panel 114 (with closure element 116, and the rear panel 122 is folded downward. Then the rear panel 122 is secured (e.g., again adhesively, fused, stapled, bonded, etc.) to securing flap 130. The closure elements 116 and 126 are designed to engage or lock the segments of the lens box after closure. The lens securing openings 112 are used to secure a lens (not shown) within the lens box (not shown). As mentioned above, the shifting of the three segments, 1) the lens box side segment 118, 2) the lens support frame top panel 114, and 3) the lens support frame side panel 110 (with lens securing opening 112 therein) moves the lens securing opening 112 over the lens. The securement of the lens within the lens securing opening 112 can be easily explained by reference to FIG. 3.

Figure 3:
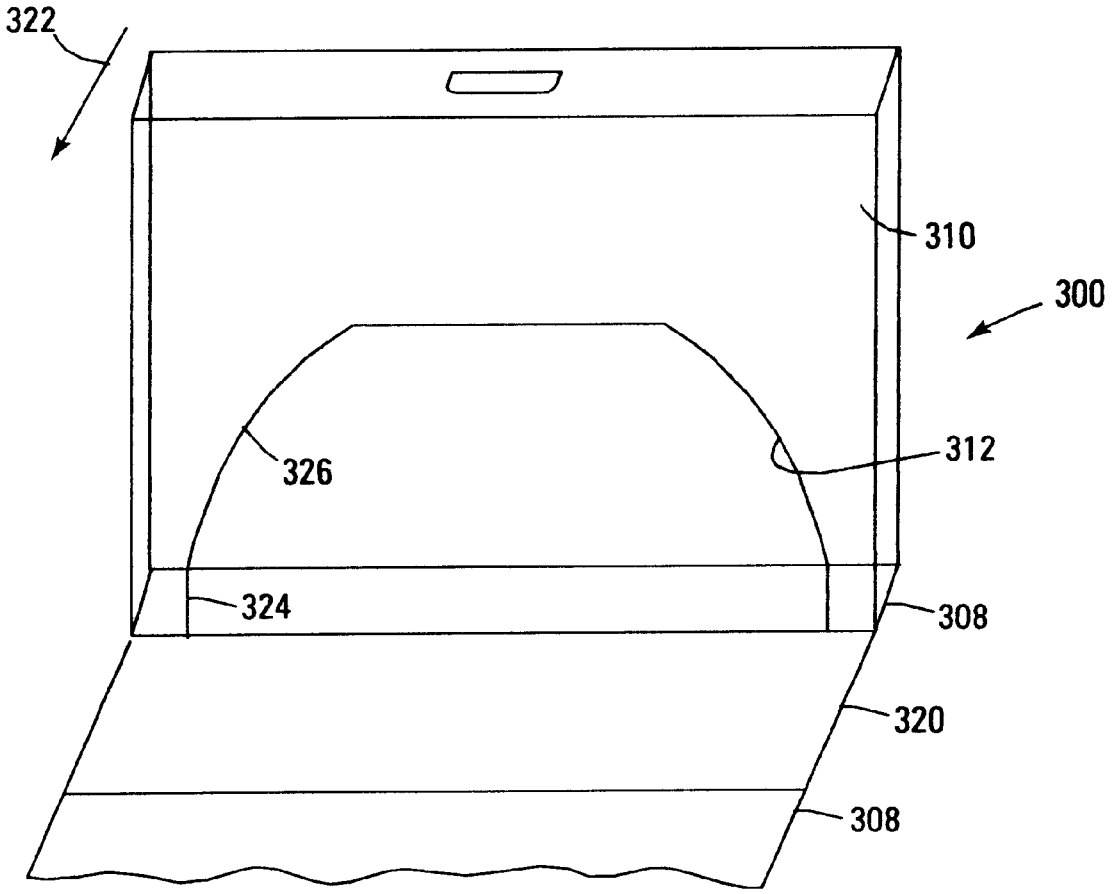
FIG. 3 shows a perspective view of a cut-out of half a lens box according to the invention.

FIG. 3 shows a perspective cut-away view of half of the inside of a lens box according to the invention 300. The lens support frame flap 310 (with lens securing opening 312 therein) will receive a lens in opening 312. The lens support frame securing flap 320 is secured to the lens box bottom segment 308. This stabilizes the shifting of the three segments, 1) the lens box side segment 118, 2) the support frame top element 114, and 3) the lens support frame flap 110 (with lens securing opening 112 therein) so that as they are shifted along direction 322, the opening 112 engages a lens. The lens (not shown) will have its edges engage frictionally or even somewhat compressively by the sides 324 of the opening 112 against the edges of the lens. The curved inside edge 326 of the opening 112 will restrain against upward movement of the lens within the opening 112. In this manner, the lens box of the invention tends to limit contact of the ophthalmic surfaces of the lens with any surfaces that would scratch or damage the lens, except for areas immediately around the edges of the lens, which are ordinarily cut or polished off the lens for fitting into frames.

Other configurations accomplishing ancillary similar results are well within the skill of the artisan. For example, rather than having flap 22 secured to flap 30, there could be an additional flap extension on flap 22 or flap 30 that would extend over the bottom of the box 20 or extend over the top of the box 24, respectively to effect a similar securing function. Soft lining material may be placed along the edges of the opening 12 or over the lens (e.g., a cheesecloth) to further reduce the possibility of scratching without creating any significant disposal or recycling issue. The slope along the side of segment 14 is done for convenience, and is not essential. The areas of segments 24 and 20, and segments 22 and 28, and segments 18 are approximately equal when symmetry in the box is desired. The terms vertical stem and cross-bar, when used with respect to the alignment or position of segments is a relative term, and it is not essential that one or the other must be specifically positioned in a vertical alignment for use of the blank or the box. The two series of segments tend to be perpendicularly oriented with respect to each other, with the cross-bar series of segments being perpendicular to the vertical stem series of segments, and at least one segment contained within both the cross-bar series and the vertical stem series (the bottom of the box is usually shown in this manner in the descriptions of this invention.

Figure 4:
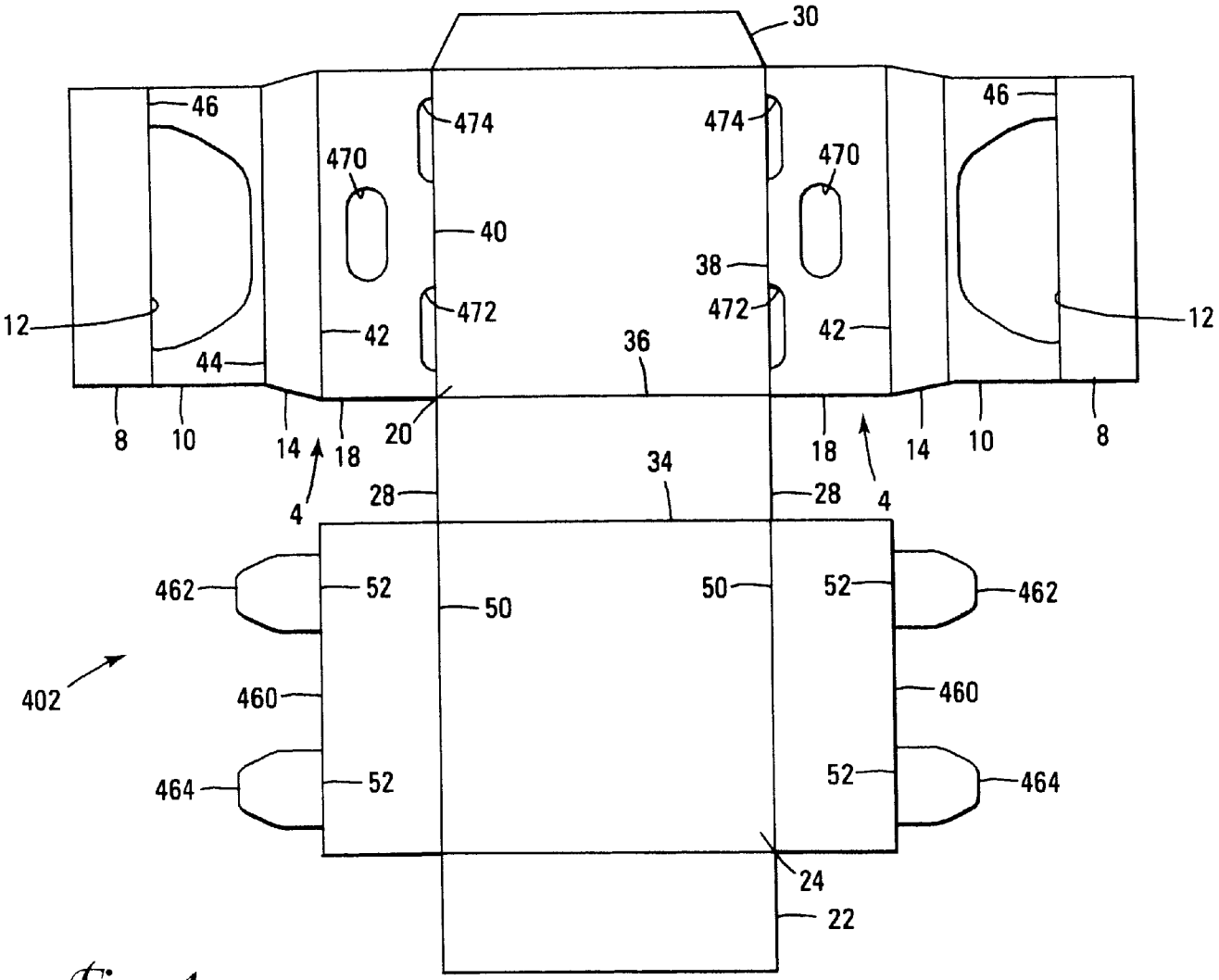
FIG. 4 shows a completely opened 'winged' T-square lens box blank that can be folded and secured into a lens box with an additional locking mechanism is provided.

FIG. 4 shows a 'winged' T-square lens box blank 402 that consists of a cross-bar 4 and a stem 6 comprising aligned box segments. The cross-bar segment 4 tends to be approximately symmetrical with two lens support frame securing flaps 8, two lens support frame side panels 10 (each with at least one lens support opening 12 therein), two lens support frame top panel 14 (shown without closure or locking elements that were shown in FIG. 1, but which may include such elements if desired), and two lens box side panels 18. The intersection of the cross-bar 4 and the vertical stem segment 6 includes the bottom of the box bottom panel 20.

The stem 6 comprises a lens box top panel 24 (shown without optional closure elements that are shown in FIG. 1), a lens box front panel 28, the lens box bottom panel 20, top of the box securing flap 22, the bottom of the box panel 20, and preferably a securing flap 30. All straight, solid lines (e.g., 32, 34, 36, 38, 40, 42, 44, 46, 48 50 and 52) are foldable lines, serrations, embossments or the like. In this 'winged' T-square lens box frame 402 there are additional features as compared to the earlier described T-square lens box frame of FIG. 1. Overlap side flaps or segments 460 are provided, with these overlap side flaps or segments 460 being provided with a set of tabs 462 and 464 to assist in securing or locking the finally constructed lens box. The lens side box panel 18 is provided with additional elements and features that also distinguish it from the T-square lens box frame of FIG. 1. Two receiving slots 472 and 474 are provided to receive the tabs 462 and 464, respectively. Additionally, an opening or hole 470 is provided to assist the user in opening the completed lens box, for viewing the lens within the box, for providing air flow within the box, and for enabling the user to readjust the position of the lens within the lens box.

What is claimed:

1. A lens box blank for folding into a lens box comprising:

a cross-bar comprising aligned box segments and a stem comprised of aligned box segments;

the stem box segments including at least a front panel, a top panel, a bottom panel, and a rear panel separated by folding lines between adjacent panels;

the cross-bar box segments comprising in symmetry about the bottom panel two side panels, two lens support frame top panels, two lens support frame side panels, each lens support frame side panel with an opening to nestle a lens, and two lens support frame securing flaps.

2. The lens box blank of claim 1 wherein at least one of the rear panel and the bottom panel has a securing flap thereon.

3. The lens box blank of claim 1 wherein the lens support frame side panel openings are at least partially arcuate.

4. The lens box blank of claim 1 wherein the top panel and at least one lens support frame top panel have a tab engaging system to connect the top panel and the at least one support frame top panel.

5. A lens box for holding an ophthalmic lens comprising:

a cross-bar comprising aligned box segments and a stem comprised aligned of aligned box segments;

the stem box segments including at least a front panel, a top panel, a bottom panel, and a rear panel separated by folding lines between adjacent panes;

the cross-bar box segments comprising in symmetry about the bottom panel, two side panels, two support frame top panels, two lens support frame panels, each lens support frame panel with an opening to nestle a lens, and two lens support frame securing flaps, the lens support frame securing flaps being secured to the bottom panel to allow three sides of a quadrilateral frame formed by the bottom panel, a side panel, a support frame top panel and a lens support frame panel to be able to shift parallel to the support frame top panel.

6. The lens box blank of claim 5 wherein at least one of the rear panel segment and the bottom panel has a flap extension thereon.

7. The lens box of claim 5 wherein the lens box support frame panel openings are at least partially arcuate.

8. The lens box of claim 5 wherein the top panel and at least one support frame top panel have a tab engaging system to connect the top panel and the support frame top panel.

9. A lens box blank for folding into a lens box comprising:

a cross-bar comprised of box segments and a stem comprised of aligned box segments;

the stem including at least a front panel, a top panel, a bottom panel with two wing side overlap segments with securing tabs at extremities of the wing side overlap segments, and a rear panel separated by folding lines between adjacent panels;

the cross-bar alignment of box elements comprising in symmetry about the bottom panel at least two side panels, at least two support frame top panels having receiving slots for receiving securing tabs at the extremities of the wing side overlap segments, and at least two lens support frame panels with an opening in each lens support frame panel to nest a lens.

10. The lens box blank of claim 9 wherein each support frame top panel has two receiving slots.

11. The lens box blank of claim 9 wherein each frame top panel has a hole therein that allows external viewing of a lens nested in the lens support frame side panels.

12. The lens box blank of claim 10 wherein each frame top flap has a hole therein that allows external viewing of a lens nested in the lens support frame flaps.

* * * * *